US005412849A

United States Patent [19]

Fudaki

[11] Patent Number: 5,412,849

[45] Date of Patent: May 9, 1995

[54] SEPARABLE BOTTOM END STOP ASSEMBLY

[75] Inventor: Tsutomu Fudaki, Toyama, Japan

[73] Assignee: Yoshida Kogyo K.K., Tokyo, Japan

[21] Appl. No.: 89,518

[22] Filed: Jul. 21, 1993

[30] Foreign Application Priority Data

Jul. 31, 1992 [JP] Japan ..... 4-205210

[51] Int. Cl.[6] ..... A44B 19/38

[52] U.S. Cl. ..... 24/388; 24/433

[58] Field of Search ..... 24/432–435, 24/387, 388, 418

[56] References Cited

U.S. PATENT DOCUMENTS

| | | | |
|---|---|---|---|
| 2,154,099 | 4/1939 | Marinsky | 24/388 |
| 2,583,386 | 1/1952 | Moehler . | |
| 2,649,638 | 8/1953 | Morin . | |
| 2,728,125 | 12/1955 | Wild . | |

FOREIGN PATENT DOCUMENTS

| | | | |
|---|---|---|---|
| 616470 | 7/1935 | Germany . | |
| 23155 | 3/1956 | Germany | 24/433 |

*Primary Examiner*—James R. Brittain

*Attorney, Agent, or Firm*—Hill, Steadman & Simpson

[57] ABSTRACT

In a separable bottom end stop assembly for a concealed slide fastener, a socket member has first- and second-plug-member insertion holes on opposite sides of a central catch plate, and an engaging tongue projecting inwardly from one side wall. When a first plug member is inserted into the socket member, a locking portion on one side of a lower end of the first plug member comes into locking engagement with the catch plate and an engaging portion on the other side of the lower end of the first plug member comes into engagement with the engaing tongue. With continued inserting of the first plug member, an inwardly directed hook-shape end of an engaging projection extending from an upper end of the socket member comes into engagement with an engaging recess in a rear wall of a slider. In this state, a second plug member is inserted into the second-plug-member insertion hole, and a slider is then pulled so as to move the socket member in a predetermined range, whereupon only the slider is pulled to join the opposed stringers together. To separate the closed stringers, the slider is pulled to push the socket member down, and then the second plug member is removed from the socket member and the slider.

5 Claims, 5 Drawing Sheets

SEPARABLE BOTTOM END STOP ASSEMBLY

BACKGROUND OF THE INVENTION

1. Field of the Invention

This invention relates to a separable bottom end stop assembly which is attached to one end of the fastener chain of a concealed slide fastener and its assembling and separating method for closing and opening the fastener chain by pulling a slider in the closing and opening directions.

2. Description of the Related Art

Various separable bottom end stop assemblies for concealed slide fasteners are currently known. For example, in the separable bottom end stop assembly disclosed in Japanese Utility Model Publication No. Sho 38-7939, the first plug member is formed integrally with the socket member.

Also in the separable bottom end stop assembly of Japanese Utility Model Publication No. Sho 51-4816, the first plug member is formed integrally with the socket member.

Either of these conventional separable bottom end stop assemblies is a two-component type in which the socket member and the first plug member are formed integrally. Assuming that a concealed slide fastener with the two-component type separable bottom end stop assembly is sewn onto a garment, since it is required to sew near the folded portions of the fastener stringers, smooth sewing cannot be achieved as the socket member, which is integral with the first plug member already attached to the stringer, would interfere with the sewing.

Even if the concealed slide fastener with the conventional separable bottom end stop assembly could be attached to a garment, it would be difficult to insert the stringer, to which the second plug member is attached, into the socket member exactly to start moving the slider because of the presence of the folded part of the stringer. Consequently this conventional type separable bottom end stop assembly could not be of practical use.

Further, with the conventional separable bottom end stop, the second plug member may be accidentally removed from the socket member easily.

SUMMARY OF THE INVENTION

With the foregoing problems in view, it is an object of this invention to provide a separable bottom end stop assembly for a concealed slide fastener, in which a socket member is attached to one stringer after the one stringer is sewn to a garment so that the socket member would not interfere with the sewing, and in which it is possible to insert a second plug member into the socket member exactly with ease so that the fastener chain of the concealed slide fastener can be coupled and separated in a simple manner.

In order to accomplish the above object, there is provided, according to a first aspect of the invention, a separable bottom end stop assembly for a concealed slide fastener, comprising: a socket member having a catch plate and an engaging tongue; a first plug member having a locking portion and an engaging portion; and the socket member further having an engaging projection adapted to engage in an engaging recess formed in a slider body of the concealed slide fastener, whereby the socket member is moved with the slider body within a predetermined range when a slider is pulled to slide on the concealed slide fastener.

Specifically, the catch plate is formed on a central upper portion of a rear wall at an upper side of the socket member. The engaging tongue projecting from a side wall and the catch plate define a first-plug-member insertion hole of the socket member. A resilient tongue of the socket member projecting from a side wall and terminating in a resiliently deformable end portion and the catch plate define a second-plug-member insertion hole. The engaging projection has a hook-shape end. In this specification, an outer side of the first plug member means the side which faces the second plug member, and the other side of the first plug member is called an inner side. The locking portion and the engaging portion are projecting outwardly and inwardly, respectively, from a lower end of the first plug member.

According to a second aspect of the invention, there is provided a method of assembling and separating a separable bottom end stop for a concealed slide fastener, comprising the steps of: inserting a first plug member, which is attached to one stringer, through a slider and into a socket member in such a manner that the first plug member is movable forwardly and backwardly in the socket member; inserting a second plug member, which is attached to the other stringer, through the slider and into the socket member; engaging the slider with the socket member; moving the slider and the socket member on the concealed slide fastener within a predetermined range in the fastener closing direction until the slider disengage from the socket member; and moving only the slider in the fastener closing direction to close the concealed slide fastener, and to separate the bottom end stop assembly, the slider is brought into contact with the socket member, and is moved further with the socket member, whereby the second plug member may be removed from the socket member.

The operation of this separable bottom end stop assembly and its assembling and separating method will now be described. As shown in FIG. 1, the first plug member which is attached to one stringer is inserted through the slider and then the first plug member is inserted into the first-plug-member insertion hole against the resilience of the engaging tongue and of the catch plate until the locking portion comes into engagement with the end of the catch plate. Then the slider is forced against the socket member to bring the hook-shape end of the engaging projection into engagement with the engaging recess in the rear wall of the slider body, thus causing an intimate contact between the socket member and the slider.

Now, the second plug member which is attached to the other stringer is inserted through the slider, and the second plug member is inserted into the second-plug-member insertion hole as shown in FIG. 2, whereupon the slider is pulled upwardly in closing direction to move the socket member upwardly together. As a result, the first plug member is further forwarded into the socket member against the resilience of the engaging tongue until a free end of the engaging tongue comes into engagement with the engaging portion of the first plug member.

Then, when the slider is pulled upwardly to a predetermined extent, the socket member is stopped and, at the same time, the hook-shape end of the engaging projection is released from the engaging recess in the rear wall of the slider so that only the slider is moved in the fastener closing direction to close the fastener chain.

Next, when the slider is moved in the direction of opening the fastener chain, the hook-shape end of the engaging projection is brought into engagement with the engaging recess of the slider. By moving the slider forward further, the socket member is moved together with the movement of the slider to assume the position of FIG. 2 so that the other stringer, to which the second plug member is attached, can be removed from the socket member and the slider. Thus the fastener chain can be separated.

DETAILED DESCRIPTION

An embodiment of a separable bottom end stop assembly, for a concealed slide fastener, of this invention will now be described in detail with reference to the accompanying drawings.

Figure 1:
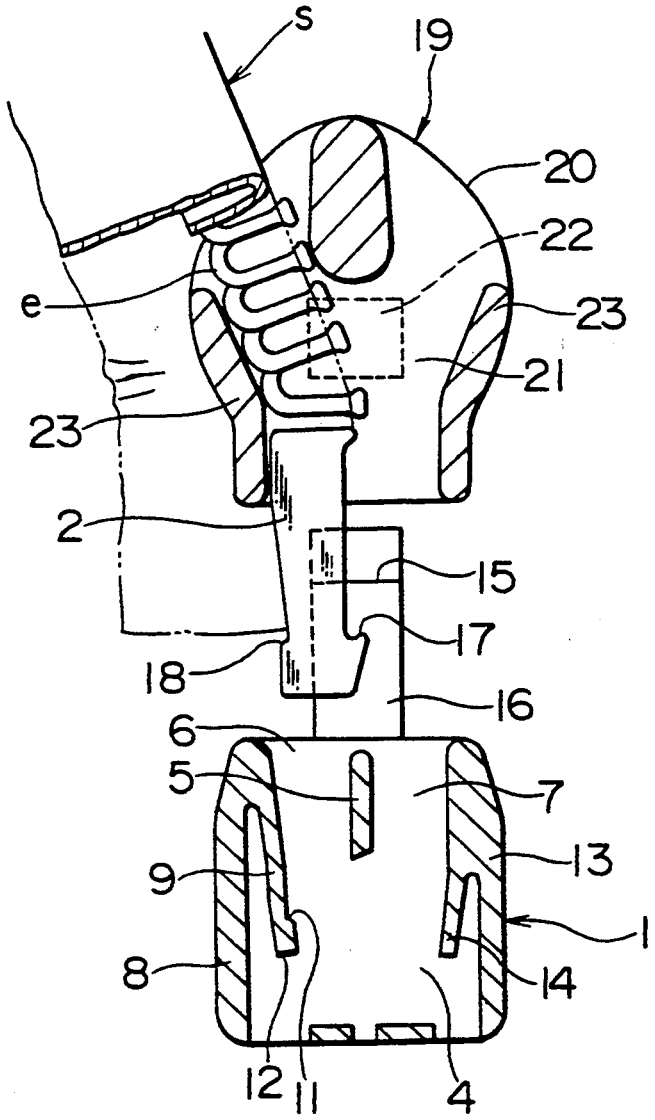
FIG. 1 is a plan view, partly in cross section, of a separable bottom end stop assembly, showing a first plug member immediately before being inserted into a socket member.
Figure 2:
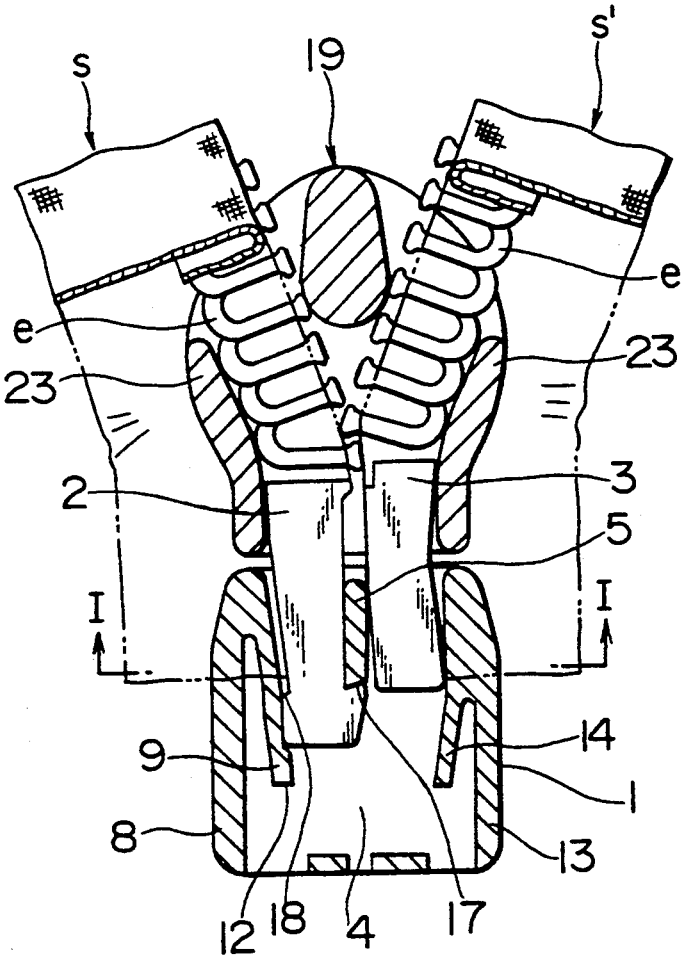
FIG. 2 is a plan view, partly in cross section, of the separable bottom end stop assembly, showing both the first plug member and a second plug member being inserted into the socket member.
Figure 3:
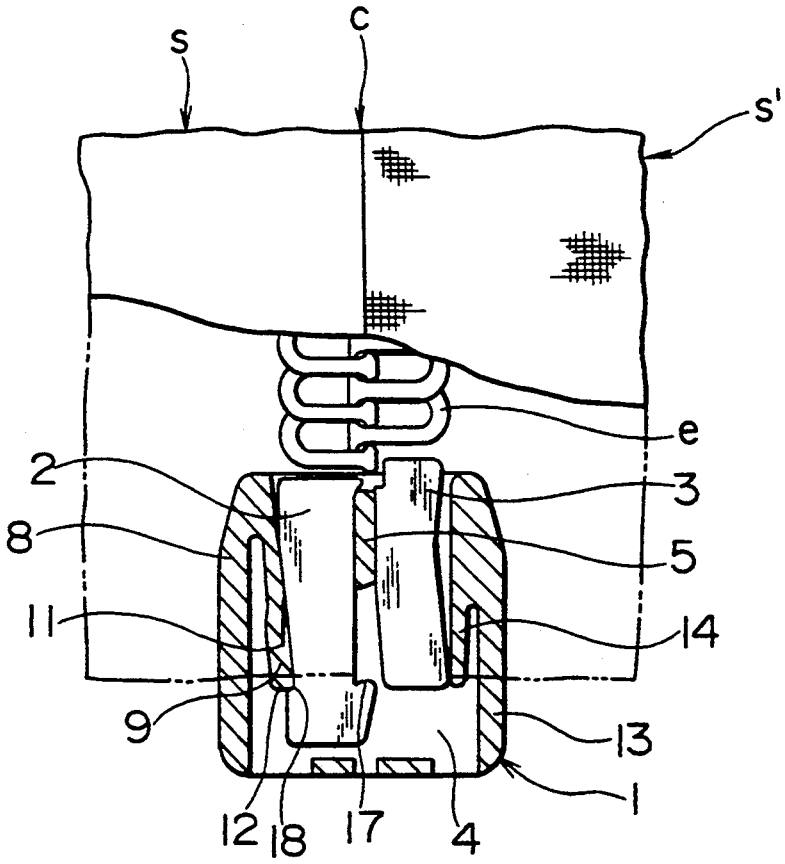
FIG. 3 is a plan view, partly in cross section, of the separable bottom end stop assembly, with a closed fastener chain.
Figure 4:
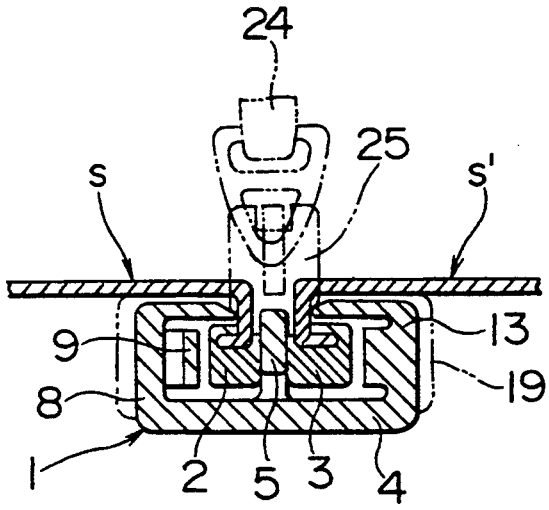
FIG. 4 is a cross-sectional view taken along line I—I of FIG. 2.
Figure 5:
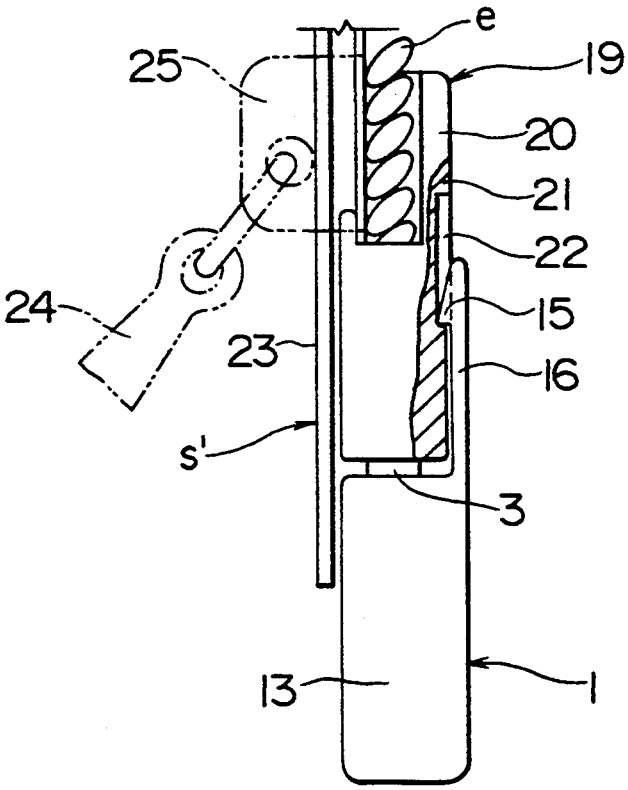
FIG. 5 is a side view, with part broken away, of the separable bottom end stop assembly, showing a slider being engaged with the socket member.
Figure 6:
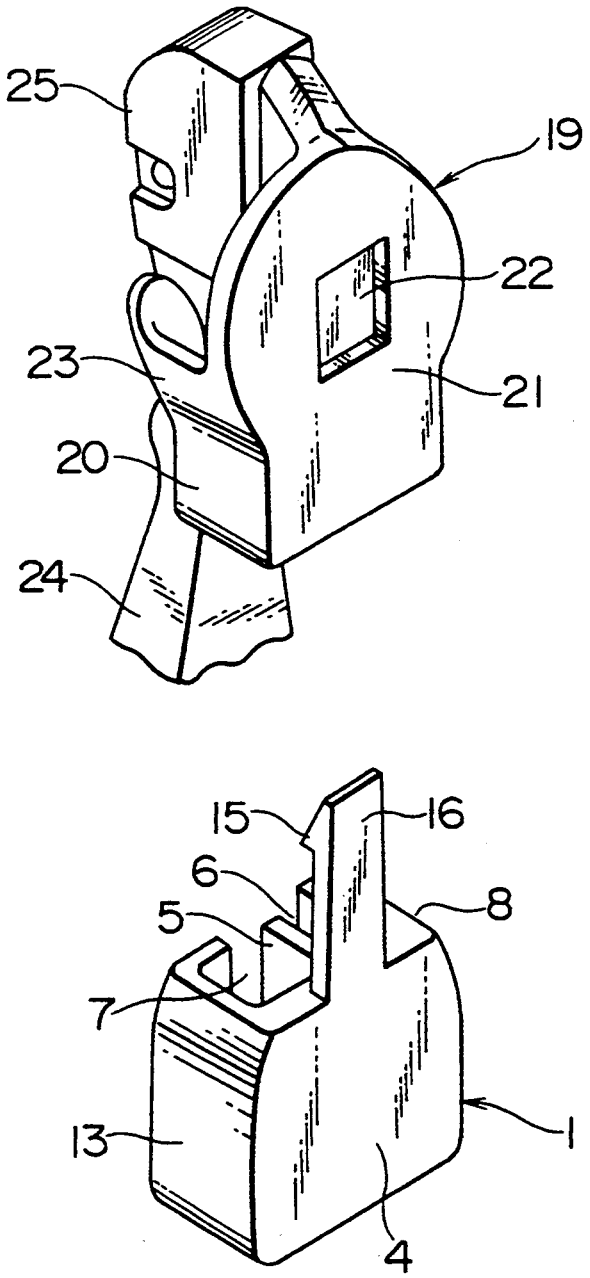
FIG. 6 is a rear perspective view showing the slider and the socket member.

The separable bottom end stop assembly of this invention has a three-member structure composed of a socket member 1, a first plug member 2 and a second plug member 3, as shown in FIGS. 1, 2 and 3. The socket member 1 has a catch plate 5 formed on a central upper portion of a rear wall 4 at an upper side of the socket member 1 and having a resiliently deformable free end. The catch plate 5 has at opposite sides a first-plug-member insertion hole 6 and a second-plug-member insertion hole 7. A front wall of the socket member 1 has an opening through which the folded portions of a pair of confronting stringers s, s′ can be inserted.

The socket member 1 has an engaging tongue 9 projecting from a side wall 8 of the first-plug-member insertion hole 6 and terminating in a resiliently deformable free end. The engaging tongue 9 has an enlarged head 12 at its free end and a ledge 11 contiguous to the enlarged head 12. A resilient tongue 14 projects from a side wall 13 of the second-plug-member insertion hole 7 and terminates in a resiliently deformable free end. An engaging projection 16 extends from an upper end of the rear wall 4 and terminates in an inwardly bent hook-shape end 15.

The first plug member 2 is attached to a lower end of one stringer s and has a hook-shaped locking portion 17 and an engaging portion 18 projecting in opposite directions from a lower end of the first plug member 2. When the first plug member 2 is inserted into the first-plug-member insertion hole 6 of the socket member 1, the locking portion 17 comes into locking engagement with the catch plate 5 and, at the same time, the lower end of the first plug member 2 at a side opposite to the locking portion 17 comes into contact with the ledge 11 of the engaging tongue 9. With continued inserting of the first plug member 2, the engaging portion 18 comes into engagement with the enlarged head 12 of the engaging tongue 9.

The first plug member 2 has a width which increases gradually as it goes from the portion between the locking portion 17 and the engaging portion 18 toward the upper end of the first plug member 2.

The second plug member 3 is attached to a lower end of the other stringer s′ and has an inwardly warped bow shape. When the second plug member 3 is inserted into the second-plug-member insertion hole 7 of the socket member 1 to the deepest, the lower end surface of the second plug member 3 comes into press contact with the resilient tongue 14.

Since an end of the catch plate 5 is resiliently movable, the catch plate 5 is pressed by the first plug member 2 to press the second plug member 3 so that the second plug member 3 cannot be easily removed from the socket member 1.

The slider 19 has, in a rear wall 21 of a slider body 20, an engaging recess 22 in which the hook-shape end 15 of the engaging projection 16 extending from the socket member 1 will come into engagement when the slider 19 is brought into contact with the socket member 1. When the slider 19 is pulled upwardly from the position of FIG. 2 in the direction of closing the fastener chain c (upwardly in FIG. 2), the socket member 1 also will be pulled upwardly and then stop in the position of FIG. 3, whereupon the hook-shaped end 15 will be released from the engaging recess 22 under the pulling force, allowing only the slider 19 to continue sliding to close the fastener chain c.

On the contrary, for separating the assembled bottom end stop, the slider 19 is pulled in the fastener opening direction to contact the socket member 1 so that the hook-shaped end 15 of the locking projection 16 extending from the socket member 1 comes into engagement with the engaging recess 22 formed in the slider body 20 of the slider 19, whereupon the slider 19 is further moved together with the socket member 1 to the position of FIG. 2, in which the other stringer s′ with the second plug member 3 attached thereto can be removed from the socket member 1 and the slider 19 with ease.

In several views, reference numeral 23 designates a guide flange for guiding a row of fastener element e inserted through the slider 19, and 24 designates a pull tab attached to a lug 25.

The main features of the separable bottom end stop assembly of this invention, unlike that of the prior art, are that a three-member structure composed of the socket member 1, the first plug member 2 and the second plug member 3 and that the socket member 1 is adapted to be attached to the first plug member 2. Further, the socket member 1 is slidable with the slider 19 in a predetermined range with respect to the fastener chain c. For coupling the opposite stringers s, s′, the first plug member 2 attached to one stringer s is inserted through the guide channel of the slider 19 and then longitudinally movably inserted into the socket member 1. Also the second plug member 3 attached to the other stringer s′ is inserted through the slider 19 and then inserted into the socket member 1, whereupon the slider 19 is pressed against the socket member 1 to be locked therewith. The slider 19 together with the socket member 1 is moved in the fastener closing direction in a predetermined range, whereupon only the slider is moved further to close the fastener chain c. For separating the opposed stringers s, s', the slider 19 is slid in the fastener opening direction to push the socket member 1 until the second plug member 3 can be removed from the socket member 1 and the slider. This method has no existence in the past.

Following are the results with the separable bottom end stop assembly for a concealed slide fastener and the concealed slide fastener assembling and separating method according to this invention.

Since the separable bottom end stop assembly of this invention has a three-member structure composed of the socket member 1, the first plug member 2, and the second plug member 3, the socket member 1 having the catch plate 5 and the engaging tongue 9, the first plug member 2 having the locking portion 17 for locking engagement with the catch plate 5 and the engaging portion 18 for engagement with the engaging tongue 9, the socket member 1 further having the engaging projection 16 engageable with the engaging recess 22 formed in the slider body 20 so that the socket member 1 is moved in a predetermined range together with the slider 19 when the slider 19 is pulled up in the fastener closing direction, it is possible to attach the socket member 1 to the first plug member 2 after the opposite stringers s, s' are sewn near their folded portions to a garment when the concealed slide fastener is sewn to the garment, thus preventing the socket member 1 from interfering with the sewing operation.

Further, since the resilience of the catch plate 5 and of the engaging tongue 9 is utilized, it is possible to insert the first plug member 2 into the socket member 1 in a very simple operation. Likewise it is possible to insert the second plug member 3 into the socket member 1 by utilizing the resilience of the catch plate 5 and of the resilient tongue 14. Since the socket member 1 and the slider 19 can be coupled together by the engaging mechanism, it is possible to bring the slider 19 into intimate contact with the socket member 1 accurately so that the smooth coupling and opening of the opposed stringers can be achieved.

Furthermore, this method comprises inserting a first plug member 2, which is attached to one stringer s, through a slider 19 and into a socket member 1 in such a manner that the first plug member 2 is movable forwardly and backwardly in the socket member 1, inserting a second plug member 3, which is attached to the other stringer s', through the slider 19 and into the socket member 1, engaging the slider 19 and the socket member 1, moving the slider 19 and the socket member I on the concealed slide fastener within a predetermined range in the fastener closing direction, and moving only the slider 19 in the fastener closing direction to close the concealed slide fastener, and to separate the bottom end stop assembly, the slider 19 is brought into contact with the socket member 1 and is moved further with the socket member 1. Thus, the other stringer s' attached to the second plug member 3 can be threaded through and removed from the slider 19 and the socket member 1 in a very simple operation.

The purpose of moving the socket member 1, together with the slider 19, on the fastener chain c in a predetermined range, is to eliminate the cause for any local uncoupling near the socket member 1 when the fastener chain c is closed by the slider 19 and to enable the inserting and removing of the second plug member 3 into and from the socket member 1 simply, which could not have been realized with the conventional art.

What is claimed is:

1. A separable assembly for a concealed slide fastener, comprising:

a socket member having a catch plate separating said socket member into two plug member insertion holes, an engaging tongue located within said socket member adjacent a first insertion hole, and an engaging projection extending from said socket member, a slider body having an engaging recess, said engaging projection adapted to engage said recess; and a first plug member having a locking portion and an engaging portion, said locking portion adapted to engage said catch plate when said first plug member is in a first position in said socket member to prevent removal of said first plug member from said socket member, and said engaging portion adapted to engage said engaging tongue when said first plug member is in a second position in said socket member when said socket member is moved with the slider body a predetermined distance equal to a distance between said first and second positions when a slider is pulled to slide on the concealed slide fastener in a fastener closing direction.

2. A separable assembly for a concealed slide fastener, comprising:

a socket member having a catch plate separating said socket member into two plug member insertion holes, an engaging tongue located within said socket member adjacent a first insertion hole, and an engaging projection extending from said socket member, a slider body having an engaging recess said engaging projection adapted to engage said recess; and a first plug member having a locking portion and an engaging portion, said locking portion adapted to engage said catch plate when said first plug member is in a first position in said socket member to prevent removal of said first plug member from said socket member, and said engaging portion adapted to engage said engaging tongue when said first plug member is in a second position in said socket member when said socket member is moved with the slider body a predetermined distance equal to a distance between said first add second positions when a slider is pulled to slide on the concealed slide fastener in a fastener closing direction, wherein said catch plate is formed on a central upper portion of a rear wall at an upper side of said socket member, said engaging tongue projecting from a side wall and said catch plate define a first-plug-member insertion hole of said socket member, a resilient tongue of said socket member projecting from a side wall and terminating in a resiliently deformable end portion and said catch plate define a second-plug-member insertion hole, said engaging projection has a hook-shaped end, and said locking portion and said engaging portion project outwardly and inwardly, respectively, from a lower end of said first plug member.

3. A slide fastener, comprising:

a first tape having a first plurality of engaging elements arranged longitudinally thereon and a first plug member located at an end region of said tape and having a locking portion and an engaging portion;

a second tape having a second plurality of engaging elements arranged longitudinally thereon for engagement with said first plurality of engaging elements and having a second plug member located at an end region of said second tape;

a socket member having a rear wall and first and second side walls connected spaced apart from said rear wall, a catch plate extending from said rear wall and located between said side walls separating said socket member into first and second plug member insertion holes, an engaging tongue extending from said first side wall adjacent said first insertion hole, and an engaging projection extending from said rear wall, said locking portion of said first plug member adapted to engage said catch plate when said first plug member is moved into said first insertion hole to a first depth to prevent removal of said first plug member from said socket member, and said engaging portion adapted to engage said engaging tongue when said first plug member is moved into said first insertion hole to a second depth;

a slider body movable along said first and second plurality of engaging elements of said first and second tape in a fastener closing direction and a fastener opening direction longitudinally thereof, said slider body having a rear wall with an engaging recess, said engaging projection of said socket member adapted to engage said recess when said slider body is positioned adjacent said socket member;

said socket member having a resilient tongue projecting from said second side wall inwardly toward said catch plate, said second plug member insertion hole defined between said resilient tongue and said catch plate, for gripping said second plug member once inserted therein.

4. A slide fastener, comprising:

a first tape having a first plurality of engaging elements arranged longitudinally thereon and a first plug member arranged below the first plurality of engaging elements and having a free end with a locking means and an engaging means arranged thereon;

a second tape having a second plurality of engaging elements for engagement with said first plurality of engaging elements, said second plurality of engaging elements arranged longitudinally on said second tape, said second tape having a second plug member arranged below the second plurality of engaging elements and having a free end;

a socket member having a catch plate separating said socket member into first and second plug member insertion holes, and a first tongue located within said socket member adjacent said first insertion hole, and a second tongue located within said socket member adjacent a second insertion hole;

said second plug member arranged and adapted to be inserted into said second plug member insertion hole to be resiliently gripped between said catch plate and said second tongue;

said locking means of said first plug member for engaging said catch plate when said first plug member is inserted into said socket member to a first depth to prevent removal of said first plug member from said socket member, and said engaging means of said first plug member for engaging said first tongue when said first plug member is inserted into said socket member a second depth;

a slider body arranged to slide along said first and second pluralities of engaging elements of said first and second tapes in a fastener closing direction and a fastener opening direction; and means applied between said socket member and said slider body for releasably fastening said slider body to said socket member and for disengaging said slider body from said socket member after said socket member is moved a distance along said first and second tapes equal to the distance between said first depth and said second depth.

5. The slide fastener according to claim 4, wherein said means applied between said second member and said slider body comprises a recess arranged on said slider body and a projection extending from said socket member and engageable into said recess, said projection having a hooked end.

* * * * *